United States Patent [19]

Blumenthal

[11] Patent Number: 4,657,443

[45] Date of Patent: Apr. 14, 1987

[54] ARRANGEMENT FOR SUPERVISING SYNCHRONOUS DISPLACEMENT OF THE PISTONS OF TWO CYLINDER-AND-PISTON UNITS

[75] Inventor: Güenter Blumenthal, Herten-Westerholt, Fed. Rep. of Germany

[73] Assignee: Bochumer Eisenhuette Heintzmann GmbH & Co., Bochum, Fed. Rep. of Germany

[21] Appl. No.: 838,555

[22] Filed: Mar. 11, 1986

[30] Foreign Application Priority Data

May 21, 1985 [DE] Fed. Rep. of Germany ..... 3518162

[51] Int. Cl.[4] ..... E21D 23/16; E21D 23/26

[52] U.S. Cl. ..... 405/302; 91/171; 91/170 MP; 405/294

[58] Field of Search ..... 405/291, 302, 299, 294; 91/170 MP, 171, 189 R, 520

[56] References Cited

U.S. PATENT DOCUMENTS

| | | | |
|---|---|---|---|
| 3,968,730 | 7/1976 | Lionet | 91/171 |
| 4,343,226 | 8/1982 | Ribeiro de Almeida | 91/171 |
| 4,534,681 | 8/1985 | Weirich et al. | 405/302 X |
| 4,586,424 | 5/1986 | Nerlich | 405/302 X |

*Primary Examiner*—Dennis L. Taylor
*Attorney, Agent, or Firm*—Michael J. Striker

[57] ABSTRACT

An arrangement for supervising and controlling synchronous displacement of respective pistons of two cylinder-and-piston units, especially of an advancement and a roof cap displacement unit of a roof support assembly for use in underground mining, comprises first and second conduit systems each having two branches each connected with one of the piston and annular spaces of a different one of the units; a switching valve interposed between pressure and a return conduits and the first and second conduit systems; and first and second shut-off valves respectively interposed in those of the branches of the first and second conduit systems which lead to the piston spaces. Measurement devices measure the extent of displacement of each of the pistons, and a control and regulating arrangement determines from the outputs of the measurement devices which of the piston leads the other and causes that of the first and second shut-off valves which is associated with the leading piston to temporarily close and thus discontinue the action of the pressure differential on the leading piston until synchronism in the displacement of the two pistons is restored.

2 Claims, 2 Drawing Figures

ARRANGEMENT FOR SUPERVISING SYNCHRONOUS DISPLACEMENT OF THE PISTONS OF TWO CYLINDER-AND-PISTON UNITS

BACKGROUND OF THE INVENTION

The present invention relates to the control of the operation of hydraulic cylinder-and-piston units in general, and more particularly to an arrangement for supervising and controlling synchronous displacement of the pistons of a hydraulic advancement unit and a hydraulic roof cap displacement unit employed in a mine roof support shield arrangement used in underground mining.

There are already known various constructions of control arrangements for controlling the operation of the hydraulic cylinder-and-piston units employed in the above-mentioned mine roof support shield arrangement. In such known arrangements, each of the hydraulic units includes a cylinder bounding a piston space next to one axial face of the respective piston and an annular space surrounding a piston rod which extends from the other end face of the respective piston to the exterior of the respective unit, and pressurized hydraulic medium is selectively supplied, in dependence on the desired direction of the displacement of the respective piston, either into the piston space or into the annular space of the respective unit to provide a pressure differential which is needed for displacing the piston in the desired direction, while the spent hydrualic fluid is discharged from the respective other space. It is also known to use a switching valve for interchanging the connections between the pressurized medium supply conduit and the return conduit, on the one hand, and the conduits which lead to the respective spaces of the hydraulic units, on the other hand, to thereby change the directions of displacements of the respective pistons.

During the movement of, for instance, a mine face conveyor, which also serves as a counterbearing for a following displacement of the protective shield arrangement, and especially during the advancement of such conveyor toward the mine face which recedes as the material being mined is removed from such mine face, the protective roof support shield arrangements remain, as a rule, in a bracing engagement with the mine floor and the mine roof for a certain period of time. During the mining operation, the distance between the main roof cap of the shield arrangement and the mine face gradually increases. This distance is bridged by respective displaceable roof caps. In this connection, it is desirable for the respective displaceable roof cap to be gradually displaced or extended beyond the main roof cap toward the mine face to the same extent as the mine face conveyor is advanced relative to the protective roof support shield arrangements.

For this purpose, there are already known purely hydraulic synchronous run systems which make sure that the displacement cylinder-and-piston units which displace the displaceable roof caps are always actuated in such a manner that the displaceable roof caps are extended to an extent corresponding to the displacement of the piston of the respective advancement cylinder-and-piston unit which is interposed between the protective roof shield arrangement and the mine face conveyor. However, purely hydraulic synchronous run systems are, of necessity, rather bulky so that they require a considerable volume of available space for their accommodation.

In order to reduce the demand for the accommodation space for the control arrangement, there have already been proposed combined electrical and hydraulic synchronous run control systems. In synchronous run control systems of this type, respective electrical or electronic displacement measurement devices are associated with the advancement cylinder-and-piston units as well as with the displacement cylinder-and-piston units, such devices being then connected with a programmable electronic control and regulating arrangement. The annular and piston spaces of the advancement and displacement cylinder-and-piston units are then connected via respective multi-way valves to the hydraulic supply and return conduits. While it is true that it was possible, by using the electronic control and regulating arrangement, to reduce the overall space consumption for the control arrangement, the multi-way valves which are being used in this connection are still quite expensive both as to their sizes and their number. This, in turn, necessitates the provision of a correspondingly high number of connection and interconnection conduits.

SUMMARY OF THE INVENTION

Accordingly, it is a general object of the present invention to avoid the disadvantages of the prior art.

More particularly, it is an object of the present invention to provide an arrangement for supervising and controlling the synchronous displacement of two pistons, which arrangement does not possess the disadvantages of the known arrangements of this kind.

Still another object of the present invention is so to construct the arrangement of the type here under consideration as to reduce the number of connecting conduits and valves in the hydraulic part of the arrangement without increasing the complexity of the electrical part of such arrangement.

A concomitant object of the present invention is so to design the arrangement of the above type as to be relatively simple in construction, inexpensive to manufacture, easy to use, and reliable in operation nevertheless.

In pursuance of these objects and others which will become apparent hereafter, one feature of the present invention resides in an arrangement for supervising and controlling synchronous displacement of respective pistons of a first and a second cylinder-and-piston unit, especially of an advancement and a roof cap displacement unit of a roof support assembly for use in underground mining, each of such units including a cylinder bounding a piston space next to one axial face of the respective piston and an annular space surrounding a piston rod which extends from the other end face of the respective piston to the exterior of the respective unit, this arrangement comprising means for supplying a pressurized hydraulic medium; means for discharging a spent hydraulic medium; first conduit means having two branches each connected with one of the spaces of a different one of the units; second conduit means also having two branches each connected to the other of the spaces of a different one of the units; switching valve means interposed between the supplying and discharging means and the first and second conduit means and operative for simultaneously selectively connecting the supplying means with one, and the discharging means with the other, of the first and second conduit means to subject the respective piston to a pressure differential;

first and second shut-off valve means respectively interposed in one of the branches of the first and second conduit means which leads to a different one of the units; means for detecting the extent of displacement of each of the pistons; and means for determining from the output of the detecting means which of the piston leads the other and for causing that of the first and second shut-off valve means which is associated with the leading piston to temporarily close and thus discontinue the action of the pressure differential on the leading piston until synchronism in the displacement of the two pistons is restored.

The considerable reduction of the hydraulic equipment expenditure with respect to valves, connecting conduits and the like is achieved in that, in each instance, the shut-off or two-port two-position valve which is displaceable by the control and regulating arrangement, for instance, against a spring force, is inserted into one of the two branches of the first and second conduit means, especially into the branch which connects the piston space of the respective advancement or displacement hydraulic cylinder-and-piston unit with the switching or four-port three-position valve which constitutes a main control valve, while the other branch of the first and second conduit means, especially that which leads to the annular space of the respective advancement or displacement unit, is directly connected with the four-port three-position valve. Herein, the main control valve can be actuated either manually or automatically.

The association of the two-port two-position valves is such that, in the absence of electrical control pulses from control inputs of the respective two-port two-position valves, such valves are displaced into positions in which the respective spaces, especially piston spaces, are disconnected from the pressure and/or the return conduits or, in other words, from the supply and discharge means. Under these circumstances, the supply of the pressurized hydraulic medium into the respective annular spaces cannot cause any displacement of the respective piston. Only after the respective two-port two-position valve has been displaced into its other end position, either in response to the displacement of the four-port two-position valve or on the basis of displacement-dependent comparison measurements performed at the advancement cylinder-and-piston unit as well as at the displacement cylinder-and-piston unit, as well as after the evaluation of the comparison measurements in the electronic control and regulating arrangement are the piston spaces connected either to the pressure conduit or to the return conduit depending on the operating direction of the cylinder-and-piston units, so that a displacement of the mine face conveyor and/or of the displaceable roof cap can now take place.

During the manual or automatic actuation of the four-port three-position valve, for instance, in order to supply the pressurized hydraulic medium in a so-called scissored-in advancement cylinder-and-piston unit for the purpose of advancing the mine face conveyor, a signal is simultaneously furnished to the control and regulating arrangement. This signal is evaluated by the control and regulating arrangement and is converted by such arrangement into a control or command signal to the two-port two-position valves causing the latter to be displaced into their aforementioned other positions in which they permit passage of the hydraulic medium therethrough. This means that the annular spaces of the advancement cylinder-and-piston unit and of the displacement cylinder-and-piston unit are now connected with the four-port three-position valve. Herein, the piston space of the advancement cylinder-and-piston unit, together with the annular space of the displacement cylinder-and-piston unit, is connected with the return conduit, while the piston space of the displacement cylinder-and piston unit and the annular space of the advancement cylinder-and-piston unit are commonly connected to the pressure conduit.

Now, as the pressurized hydraulic medium is supplied to the annular space of the advancement cylinder-and-piston unit, the piston of the advancement cylinder-and-piston unit is being displaced, and so is the piston of the displacement cylinder-and-piston unit. The movements of the two pistons are monitored by the displacement measuring devices which are associated with the two cylinder-and-piston units, and are evaluated in the control and regulating arrangement for synchronism. When the control and regulating arrangement establishes, for instance, that the piston of the displacement cylinder-and-piston unit lags behind the piston of the advancement cylinder-and-piston unit, then the control and regulating arrangement causes a change in the position of the two-port two-position valve associated with the advancement cylinder-and-piston unit in such a sense that the piston space of this unit is disconnected from the return conduit. This means that the piston of the advancement cylinder-and-piston unit cannot conduct any further displacement until such time that the control and regulating arrangement has again determined that the piston of the advancement cylinder-and-piston unit and the piston of the displacement cylinder-and-piston unit are again in synchronism with each other, at which time the control and regulating arrangement causes the two-port two-position valve associated with the advancement cylinder-and-piston unit to move into its open position, so that the connection of the piston space of the advancement cylinder-and-piston unit with the return conduit is re-established.

Thus, it may be seen that, independently of the choice of the spaces of the advancement and displacement cylinder-and-piston units to which the pressurized hydraulic medium is supplied, the synchronism supervision and control arrangement of the present invention provides exactly for the separation, in each instance, of the piston space of the cylinder-and-piston unit whose piston is in the lead is separated from the pressure or from the return conduit, so that the lagging piston is able to make up the differential distance. Only after the establishment of the synchronism of the two pistons under the control of the control and regulating unit is the piston space of the unit with the previously leading piston reconnected with the pressure or return conduit.

The novel features which are considered as characteristic of the invention are set forth in particular in the appended claims. The improved arrangement for supervising and controlling synchronous advancement of the pistons of two hydraulic cylinder-and-piston units itself, however, both as to its construction and its mode of operation, together with additional features and advantages thereof, will be best understood upon perusal of the following detailed description of certain specific embodiments with reference to the accompanying drawing.

DETAILED DESCRIPTION OF THE PREFERRED EMBODIMENTS

Figure 1:
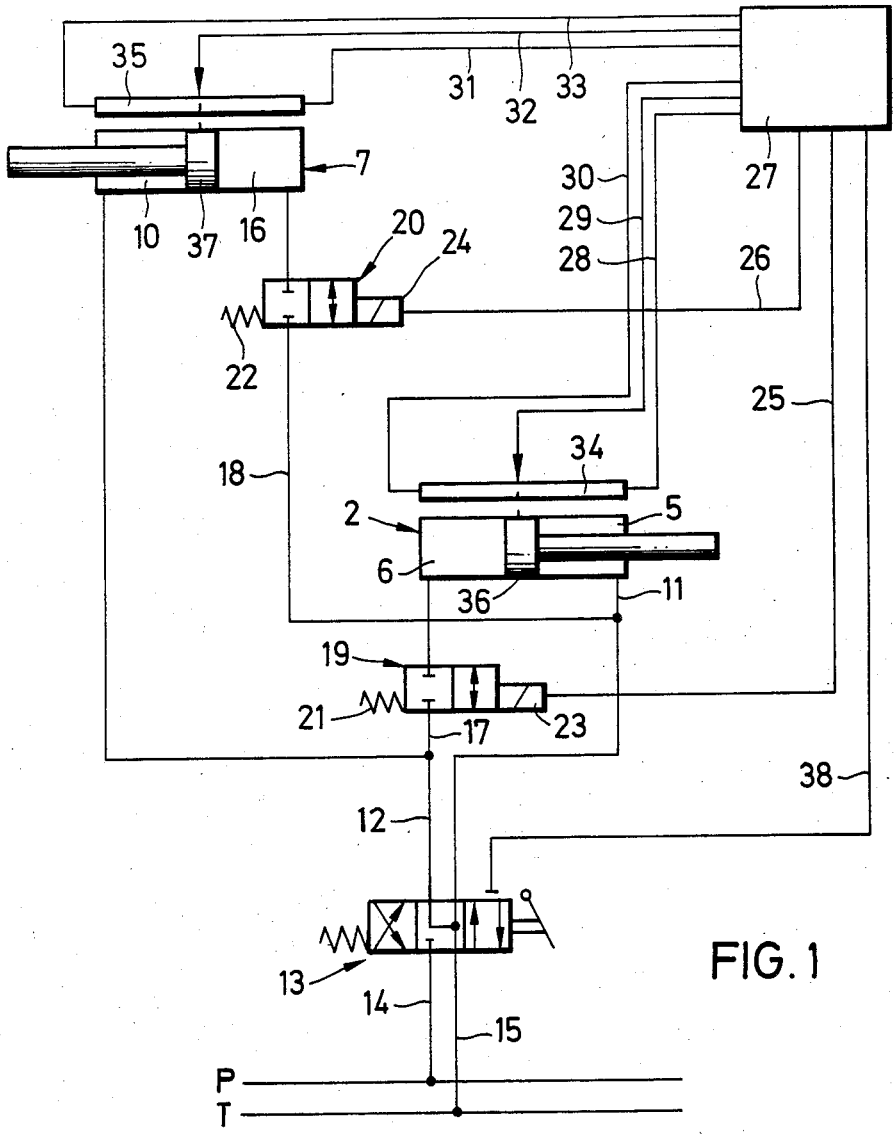
FIG. 1 is a circuit diagram of a hydraulic arrangement embodying the present invention.

Referring now to the drawing in detail, and first to FIG. 1 thereof, it may be seen that the reference characters P and T have been used therein to identify two conduits of a hydraulic medium circulation system, the conduit P being a pressure conduit and the conduit T being a return conduit. This hydraulic medium circulation system may be employed, for example, for supplying pressurized hydraulic medium to, and discharging spent hydraulic medium from, an array of mine roof support shield arrangements 1 which are used in underground mining and one of which is illustrated in a simplified fashion in FIG. 2.

Figure 2:
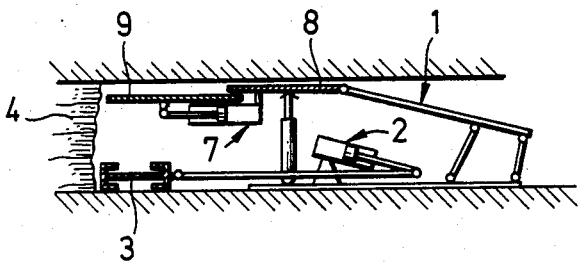
FIG. 2 is a simplified side elevational view of a protective mine roof support shield arrangement which is equipped with the hydraulic arrangement of FIG. 1.

The basic construction of the mine roof support shield arrangement 1 is well known, so that it will be described herein only to the extent needed for understanding the present invention. Turning now particularly to FIG. 2 of the drawing, it may be seen therein that each of the mine roof support shield arrangements 1 basically includes two parts, one of which engages the mine floor while the other supports the mine roof, these two parts being movable together and apart in a scissors-like fashion by means of respective props. Each of the mine roof support shield arrangements 1 is provided with at least one advancement cylinder-and-piston unit 2 which is arranged in the space delimited by the aforementioned two parts of the mine roof support shield arrangement 1. In use, when it is desired to advance a reaction bearing element, for instance a mine face conveyor 3, which is associated with the mine roof support shield arrangement 1, in the direction toward a mine face 4, the pressurized hydraulic medium is admitted into an annular space 5 (see FIG. 1) surrounding a piston rod of the advancement cylinder-and-piston unit 2. On the other hand, when it is desired to cause the mine roof support shield arrangement 1 to follow the advancement of the mine face conveyor 3 toward the mine face 4, the pressurized hydraulic medium is admitted into a piston space 6 (see FIG. 1) of the advancement cylinder-and-piston unit 2 to utilize the large piston surface for the displacement of the heavy mine roof support shield arrangement 1. Each mine roof support shield arrangement 1 further includes a displacement cylinder-and-piston unit 7 which displaces and extendable roof cap 9, which projects beyond a main roof cap 8 toward the mine face 4, in synchronism with the operation of the advancement cylinder-and-piston unit 2.

As may be seen in FIG. 1 of the drawing, the annular space 5 of the advancement cylinder-and-piston unit 2 and an annular space 10 which surrounds a piston rod of the displacement cylinder-and-piston unit 7 are directly connected by means of respective conduits 11 and 12 with a four-port three-position switching valve 13. The four-port three-position valve 13 can be actuated either manually or automatically. The four-port three-position valve 13, in turn, is connected by respective conduits 14 and 15 with the pressure conduit P and with the return conduit T.

Electrically controllable two-port two-position shut-off valves 19 and 20 are incorporated into respective conduits 17 and 18 which lead from the respective conduits 12 and 11 to the piston space 6 of the advancement cylinder-and-piston unit 2 and to a piston space 16 of the displacement cylinder-and-piston unit 7, respectively. The two-port two-position valves 19 and 20 are subjected to biassing restoration forces of respective restoring springs 21 and 22 which, in the absence of electrical signals from respective displacement actuator devices 23 and 24, return the two-port two-position valves 19 and 20 into respective positions in which the piston spaces 6 and 16 are disconnected from the pressure conduit P or from the return conduit T irrespective of the position of the four-port three-position valve 13.

The two-port two-position valves 19 and 20 are equipped with the aforementioned displacement actuator devices 23 and 24 which are connected via respective control lines 25 and 26 with a programmable control and regulating unit 27. This control and regulating unit 27 is further connected by respective lines 28 to 30 or 31 to 33 with respective displacement measurement units 34 and 35 which are associated with the advancement cylinder-and-piston unit 2 and with the displacement cylinder-and-piston unit 7, respectively. Each of the displacement measurement units 34 and 35 determines the instantaneous position of a piston 36 of the advancement cylinder-and-piston unit 2 or of a piston 37 of the displacement cylinder-and-piston unit 7, respectively, and supplies the thus obtained data to the control and regulating unit 27. The control and regulating unit 27 then performs a comparison operation and, when the advancement cylinder-and-piston unit 2 and the displacement cylinder-and-piston unit 7 are not operating in synchronism, issues a respective control command signal which so changes the positions of the two-port two-position valves 19 and 20 that the synchronous operation of the advancement cylinder-and-piston unit 2 and of the displacement cylinder-and-piston unit 7 is again restored. For this purpose, even the four-port two-position valve 13 is connected with the control and regulating unit 27 by a connecting line 38.

Having so described the construction of the arrangement of the present invention, its operation will now be explained, still with reference to FIG. 1 of the drawing.

When, for instance, the pressurized hydraulic medium is to be admitted into the annular space 5 of the advancement cylinder-and-piston unit 2, then the four-port three-position valve 13 is displaced into its right-hand end position. In response to such actuation of the four-port three-position valve 13, a signal is forwarded through the connecting line 38 to the control and regulating unit 27, which issues respective signals through the control lines 25 and 26 to the displacement actuator devices 23 and 24 of the two-port two-position valves 19 and 20, so that such two-port two-position valves 19 and 20 are displaced into their left-hand end positions in which the piston spaces 6 and 16 are connected with the return conduit T and with the pressure conduit P, respectively. The piston 36 of the advancement cylinder-and-piston unit 2 is being drawn in. During such displacement of the piston 36, the displacement measurement unit 34 associated with the advancement cylinder-and-piston unit 2, and the displacement measurement unit 35 of the displacement cylinder-and-piston unit 7, furnish respective signals, which are indicative of the position of the pistons 36 and 37 relative to one another, to the control and regulating unit 27, and such relative positions of the pistons 36 and 37 are determined in the control and regulating unit 27. When the control and regulating unit 27 establishes, for instance, that the piston 37 of the displacement cylinder-and-piston unit 7 lags behind the piston 36 of the advancement cylinder-and-piston unit 2, the control and regulating unit 27 issues, via the control line 25, a pulse to the displacement actuator device 23 of the two-port two-position valve 19 of the advancement cylinder-and-piston unit 2 in such a sense that the two-port two-position valve 19 is again displaced into its right-hand position. This means that the piston space 6 of the advancement cylinder-and-piston unit 2 is disconnected from the return conduit T, so that further displacement of the piston 36 of the advancement cylinder-and-piston unit 2 is no longer possible. Only after the control and regulating unit 27 has determined that the piston 37 of the displacement cylinder-and-piston unit 7 has caught up, that is, that it is again in synchronism with the piston 36 of the advancement cylinder-and-piston unit 2, is the two-port two-position valve 19 again displaced in the leftward direction and the piston space 6 of the advancement cylinder-and-piston unit 2 is connected with the return conduit T. Of course, if for some reason the piston 36 of the advancement cylinder-and-piston unit 2 were lagging behind the piston 37 of the displacement cylinder-and-piston unit 7, the situation would be reversed, that is, the control and regulating unit 27 would issue, via the control line 26, a pulse to the displacement actuator device 24 of the two-port two-position valve 20 of the displacement cylinder-and-piston unit 7 in such a sense that the two-port two-position valve 20 would be temporarily displaced into its right-hand position again, thus disconnecting the piston space 16 of the displacement cylinder-and-piston unit 7 from the pressure conduit P and hampering the progress of the piston 37 until synchronism is restored.

On the other hand, when it is desired to supply the pressurized hydraulic medium to the piston space 6 of the advancement cylinder-and-piston unit 2 in order to advance the mine roof support shield arrangement 1 in the direction toward the mine face 4, then the four-port three-position valve 13 is displaced into its left-hand end position. This actuation of the four-port three-position valve 13 also results in the issuance of a signal which is supplied through the control line 38 to the control and regulating unit 27, this signal being effective in the sense of causing the control and regulating unit 27 to issue signals to the displacement actuator devices 23 and 24 of the two-port two-position valves 19 and 20, causing the two-port two-position valves 19 and 20 to respectively connect the piston spaces 6 and 16 of the respective advancement cylinder-and-piston units 2 and 7 with the four-port three-position valve 13. This means that the piston space 6 of the advancement cylinder-and-piston unit 2 is now connected with the pressure conduit P and the piston space 16 of the displacement cylinder-and-piston unit 7 is connected with the return conduit T, while the annular space 5 of the advancement cylinder-and-piston unit 2 is connected with the return conduit T and the annular space 10 of the displacement cylinder-and-piston unit 7 is connected with the pressure conduit P.

It will now be assumed as an example that, during this phase of operation of the arrangement, the piston 36 of the advancement cylinder-and-piston unit 2 lags behind the piston 37 of the displacement cylinder-and-piston unit 7. Then, once the control and regulating unit 27 has established, on the basis of the information supplied by the displacement measurement units 34 and 35, that the piston 37 of the displacement cylinder-and-piston unit 7 moves more rapidly than the piston 36 of the advancement cylinder-and-piston unit 2, the control and regulating unit 27 issues a pulse through the control line 26 to the displacement actuator device 24 of the two-port two-position valve 20 of the displacement cylinder-and-piston unit 7, so that the piston space 16 of the latter is disconnected from the return conduit T. This means that the piston 37 of the displacement cylinder-and-piston unit 7 cannot move further in, and this situation exists until the control and regulating unit 27 has established a catching up or synchronism in the displacement of the piston 37 of the displacement cylinder-and-piston unit 7 with the piston 36 of the advancement cylinder-and-piston unit 2. Only then will the two-port two-position valve 20 of the displacement cylinder-and-piston unit 7 be again switched by the control and regulating unit 27 into its other end position with attendant re-establishment of the communication of the piston space 16 of the displacement cylinder-and-piston unit 7 with the return conduit T. Finally, should it for some reason be the piston 36 of the advancement cylinder-and-piston unit 2 that leads the piston 37 of the displacement cylinder-and-piston unit 7 under these circumstances, the situation would again be reversed, that is, the control and regulating unit 27 would issue, via the control line 25, a pulse to the displacement actuator device 23 of the two-port two-position valve 19 of the advancement cylinder-and-piston unit 2 to cause temporary displacement of the two-port two-position valve 20 into its righthand position, thus disconnecting the piston space 6 of the advancement cylinder-and-piston unit 2 from the pressure conduit P and stopping any further progress of the piston 36 until synchronism is restored.

It is thus assured that, independently of whether the pressurized hydraulic medium is initially supplied to the piston space 6 of the advancement cylinder-and-piston unit 2 and the annular space 10 of the displacement cylinder-and-piston unit 7 or to the annular space 5 of the advancement cylinder-and-piston unit 2 and the piston space 16 of the advancement cylinder-and-piston unit 2, the piston space 6 or 16 of the respective advancement cylinder-and-piston unit 2 or displacement cylinder-and-piston unit 7 whose respective piston 36 or 37 leads the respective other piston 37 or 36 is disconnected by the respective two-port two-position valve 19 or 20 associated therewith from the pressure or return conduit P or T and is reconnected thereto only after the control and regulating unit 27 has detected the re-establishment of synchronism between the pistons 36 and 37.

It will be understood that each of the elements described above, or two or more together, may also find a useful application in other types of arrangements differing from the type described above.

While the invention has been illustrated and described as embodied in an arrangement for supervision and control of synchronous displacement of two pistons incorporated in a hydraulic operating circuit of a mine roof support arrangement used in underground mining, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpont of prior art, fairly constitute essential characteristics of the generic and specific aspects of my contribution to the art and, therefore, such adaptations should and are intended to be comprehended within the meaning and range of equivalence of the claims.

What is claimed as new and desired to be protected by Letters Patent is set forth in the appended claims.

I claim:

1. An arrangement for supervising and controlling synchronous displacement of respective pistons of a first and a second cylinder-and-piston unit, especially of an advancement and a roof cap displacement unit of a roof support assembly for use in underground mining, each of such units including a cylinder bounding a piston space next to one axial face of the respective piston and an annular space surrounding a piston rod which extends from the other end face of the respective piston to the exterior of the respective unit, comprising means for supplying a pressurized hydraulic medium; means for discharging a spent hydraulic medium; first conduit means having two branches each connected with one of the spaces of a different one of the units; second conduit means also having two branches each connected to the other of the spaces of a different one of the units; switching valve means interposed between said supplying and discharging means and said first and second conduit means and operative for simultaneously selectively connecting said supplying means with one, and said discharging means with the other, of said first and second conduit means to subject the respective piston to a pressure differential; first and second shut-off valve means respectively interposed in one of said branches of said first and second conduit means which leads to a different one of the units; means for detecting the extent of displacement of each of the pistons; and means for determining from the output of said detecting means which of the piston leads the other and for causing that of said first and second shut-off valve means which is associated with the leading piston to temporarily close and thus discontinue the action of the pressure differential on the leading piston until synchronism in the displacement of the two pistons is restored.

2. The arrangement as defined in claim 1, wherein said first and second shut-off valve means are respectively interposed in those of said branches of said first and second conduit means which are connected to the piston spaces of the respective cylinder-and-piston units, while the annular spaces of such cylinder-and-piston units are in direct communication with said switching valve means.

* * * * *